US006988450B1

(12) United States Patent
Georgantzis et al.

(10) Patent No.: US 6,988,450 B1
(45) Date of Patent: Jan. 24, 2006

(54) ANTI-PERSONNEL AMMUNITION

(75) Inventors: Peter Georgantzis, East Stroudsburg, PA (US); Keith J. Martin, Bangor, PA (US); Andrew A. Molina, Stroudsburg, PA (US); Andrew Gowarty, E. Stroudsburg, PA (US); Anthony P. Farina, Hackettstown, NJ (US); Henry E. Hudgins, Lord's Valley, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/066,360

(22) Filed: Feb. 7, 2005

Related U.S. Application Data

(63) Continuation of application No. 10/695,736, filed on Oct. 24, 2003, now abandoned, which is a continuation of application No. 10/065,198, filed on Sep. 25, 2002, now abandoned.

(51) Int. Cl.
*F42B 22/00* (2006.01)

(52) U.S. Cl. ..... 102/401; 102/462; 102/463; 102/449; 102/506; 102/703

(58) Field of Classification Search ..... 102/462–464, 102/448, 477, 491–495, 499, 472, 431, 517, 102/449, 502, 506, 430, 438, 439, 703
See application file for complete search history.

(56) References Cited

U.S. PATENT DOCUMENTS

| | | | | |
|---|---|---|---|---|
| 319,629 | A * | 6/1885 | Russell | 102/472 |
| 2,343,818 | A * | 3/1944 | Sweeley | 102/454 |
| 3,444,813 | A * | 5/1969 | Bird | 102/449 |
| 3,602,143 | A * | 8/1971 | Critcher | 102/449 |
| 3,650,213 | A * | 3/1972 | Abbott et al. | 102/436 |
| 3,802,345 | A * | 4/1974 | La Costa | 42/78 |
| 3,991,682 | A * | 11/1976 | Peak | 102/438 |
| 4,220,090 | A * | 9/1980 | Fackler | 102/449 |
| 4,679,505 | A * | 7/1987 | Reed | 102/449 |
| 5,549,046 | A * | 8/1996 | Widner et al. | 102/202.7 |
| 5,648,637 | A * | 7/1997 | Clark, III | 102/438 |
| 5,796,031 | A * | 8/1998 | Sigler | 102/520 |
| 5,970,878 | A * | 10/1999 | Gardner | 102/449 |
| 6,240,850 | B1 * | 6/2001 | Holler | 102/439 |
| 6,748,870 | B2 * | 6/2004 | Heidenreich et al. | 102/431 |
| 2001/0042486 | A1 * | 11/2001 | Dales et al. | 102/449 |

FOREIGN PATENT DOCUMENTS

| | | | |
|---|---|---|---|
| GB | 1085045 | * | 9/1967 |

* cited by examiner

*Primary Examiner*—Michael J. Carone
*Assistant Examiner*—John A. Radi
(74) *Attorney, Agent, or Firm*—Michael C. Sachs; John F. Moran

(57) ABSTRACT

Anti-personnel tank fired ammunition designed for attacking personnel at various ranges includes a hollow base member adapted with an electric primer and a plastic or aluminum canister containing a payload at one end thereof. In operation, the hollow cartridge is loaded with a solid propellant. The electric primer which is centrally located in the solid propellant is fired and provides a flash together with the gasses needed to ignite the propellant. The burning propellant then provides the gasses needed to force the canister from the gun tube in which the ammunition is positioned.

21 Claims, 1 Drawing Sheet

ANTI-PERSONNEL AMMUNITION

This application is a continuation of application Ser. No. 10/695,736 as originally filed on Oct. 24, 2003 now abandoned, by Peter Georgantzis, now abandoned, et al, for "Anti-Personnel Ammunition", which itself is a continuation of application Ser. No. 10/065,198 filed Sep. 25, 2002 now abandoned, Peter Georgantzis, now abandoned, et al, for "Anti-Personnel Ammunition", the entire file wrapper contents of both of which applications are hereby incorporated by reference as though fully set forth.

U.S. GOVERNMENT INTEREST

The inventions described herein, may be made, used, and licensed by or for the U.S. Government for Governmental purposes.

FIELD OF THE INVENTION

This invention relates to anti-personnel ammunition. More specifically, the present invention relates to an anti-personnel tank fired ammunition round designed for attacking personnel at various ranges.

BACKGROUND OF THE INVENTION

Heretofore, a wide variety of anti-personnel weaponry and ammunition have been employed with varying degrees of success. Thus, for example, U.S. Pat. No. 3,956,990 issued to John F. Rowe on May 18, 1976 relates to anti-personnel ammunition containing highly efficient, low drag fragments normally suitable for artillery ranges which possess point blank range capability and evidence the same aerodynamic configuration as other ammunition fired from the same weapon. Fragments employed by the patentee are in the form of fin-stabilized projectiles or flechettes comprising hard materials such as steel. Although this weaponry has met with a certain degree of success, the weaponry design employed requires an internal charge together with a plurality of detonator systems to disperse the system payload. Accordingly, this design is more costly and complex, so enhancing the likelihood of failure.

U.S. Pat. No. 4,301,737 issued to Ladd Yuhash et al. on Nov. 24, 1981 relates to a projectile of intermediate size having a dual performance capability including both armor piercing for point target effectiveness and multi-directional shrapnel characteristics against area wide antipersonnel targets. The described projectile comprises a central high density core penetrator together with a plurality of radially disposed blades surrounding the core and a plastic sheath for containment the those items until used against targets. Thus, this device in addition to the anti-personnel capability also uses an armor piercing anti-tank penetrator core. Unfortunately, this approach is not practical should there be no target upon which tom direct fire. Additionally, it is less effective in that there is a reduced anti-personnel load payload, so enhancing the cost thereof.

U.S. Pat. No. 4,494,459 issued to Richard T. Ziemba on Jan. 22, 1985 relates to an explosive projectile for a round of ammunition having a forward armor piercing, high explosive charge and an aft, anti-personnel, high explosive charge in a frangible casing both of which are functioned by a single detonator assembly. As indicated by the patentee, this device uses a high explosive, armor piercing charge instead of a penetrator core. This approach is impractical due to the need for an armored target and, obviously, economically unattractive since there is an aft charge for the antipersonnel shrapnel.

U.S. Pat. No. 4,580,500 issued to Jean-Robert Fauvel et al. on Apr. 8, 1996 relates to a multiple charge munition such as a combined anti-tank and anti-personnel mine. The described munition which when placed on the ground ejects a plurality of sub-munitions. Accordingly, this provides two stages of scattering, an initial stage when the munitions are released from above the ground and a second stage when the sub-munitions are scattered from the main munitions once they are on the ground. This design differs from the heretofore described dual-purpose rounds in that both the anti-tank and the anti-personnel payload are mines. Therefore, this approach is not intended for the elimination of current personnel.

U.S. Pat. No. 4,583,461 issued to Adolph Weber on Apr. 22, 1986 relates to a method for attacking target objects by means of small bombs ejected from a carrier or canister having a controllably ignitible ejector propellant charge for ejection of small bombs upon reaching a predetermined drop height during fall into a target area. Obviously, this device is a design suitable for a longer range than is intended herein and is a classic example of small bomb weaponry.

U.S. Pat. No. 4,974,516 issued to Joseph Eyal et al. on Dec. 4, 1990 relates to a fragmentation projectile such as a single or dual purpose grenade or bomblet for a cargo projectile comprising a fragmentation body enveloping an explosive charge carrying case which fragmentation body comprises one or more fragmentation rings notched it an axial direction. This device is a dual purpose munition for both anti-personnel and anti-armor use. The anti-tank portion of the device is a highly explosive charge. However, the anti-personnel portion of the device uses the fragmentation of the casing as the projectiles. Studies have revealed that this munition is not desirable due to the duality of the design. Additionally, it has proven to be less effective with respect to the antipersonnel portion due to the lack of payload.

U.S. Pat. No. 4,515,083 issued to Anthony M. Caruso on May 7, 1985 relates to a fragmentation casing for a munition in which the size and distribution pattern of the shrapnel is controlled. This end is attained by means of a casing formed from a stacked array of rings in which angularly oriented inner and outer surface grooves form apertures at the mutual intersections. Through the control of ring size, groove depth and shape, a light weight efficient fragmentation casing is provided in which the size, shape and bursting pattern of the resulting shrapnel is regulated in a predetermined manner. The primary focus of the patentee is upon the fragmentation casing and not the munition itself as described herein.

U.S. Pat. No. 5,225,628 issued on Jul. 6, 1993 to Michael L. Heiny relates to a high impact low penetration round including a transparent casing and a plurality of deformable pellets fired from the casing as projectiles. The pellets are formed of a lead wax material that flattens and deforms upon contact with a solid object. The purpose of the patentee was to employ a non-elastic collision projectile which increases the effectiveness of each impact. However, this design has two limitations. First and foremost, the canister must have an open end which does not provide containment of the "Lead Wax Pellets". It also has temperature limitations and requires an indicator, so increasing the economic costs.

Accordingly, workers in the art have continued their efforts in search of alternative anti-personnel ammunition while eliminating the drawbacks encountered heretofore.

SUMMARY OF THE INVENTION

In accordance with the present invention, the prior art limitations have been obviated by means of a novel anti-personnel tank fired ammunition round. The described munition is designed for attacking groups of personnel at various ranges in marked contrast to defeating tanks, armored personnel carriers, aircraft or other vehicular targets. The described ammunition, much like a shotgun, is capable of dispersing a payload upon exit from its gun tube and achieves maximum dispersion, thereby eliminating a maximum number of enemy personnel.

BRIEF DESCRIPTION OF THE DRAWING

The invention will be more fully understood by reference to the following detailed description taken in conjunction with the accompanying drawing wherein.

DETAILED DESCRIPTION OF THE INVENTION

Figure 1:
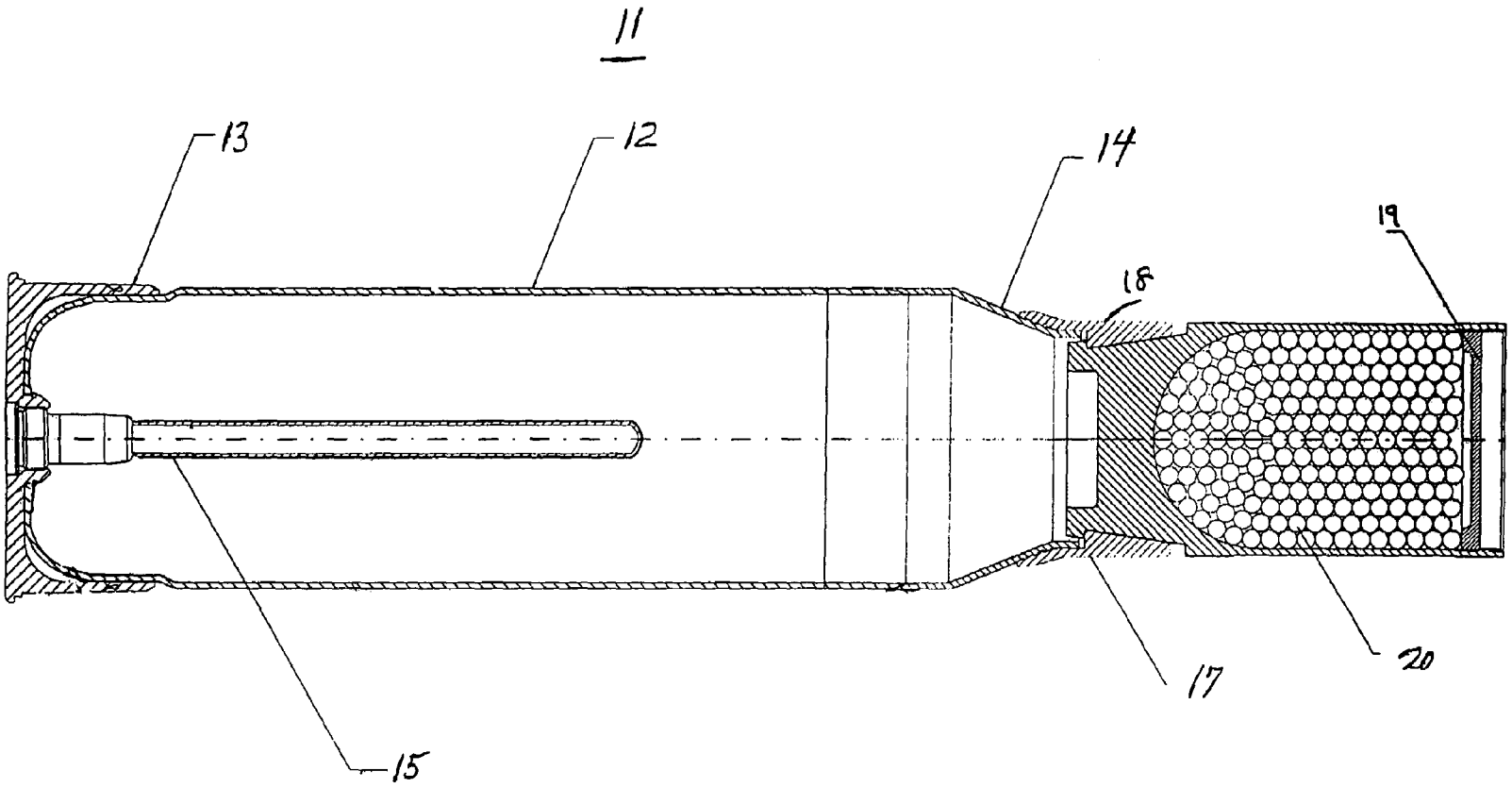
FIG. 1 is a side elevational view in cross-section of the anti-personnel ammunition of the invention.

With reference now to FIG. 1, there is shown anti-personnel ammunition 11 including a hollow casing or cartridge 12 having a base member and seal assembly 13 at one end thereof and an adapter case 14 at the other end thereof. Cartridge 12 is adapted to contain a propellant (not shown) and includes an electric primer 15 affixed to base member and seal assembly 13. Canister 16 mates with adapter case 14 and is affixed and held in place by objurators 17 and 18. Canister 16 is adapted with a cap 19 and includes a payload 20 which may comprise round steel balls, steel cubes, tungsten balls, a combination of steel balls and tungsten cubes, a combination of tungsten cubes and tungsten balls or flechettes. Canister 16 is also adapted with longitudinal grooves 21 which aid in the payload expulsion process.

Canister 16 may be either be plastic or aluminum. Top cover or cap 19 holds the payload in place. In operation, the hollow cartridge 12 is loaded with a solid propellant. Electric primer 15 which is centrally located in the solid propellant is fired and provides a flash together with the gasses needed to ignite the propellant. The burning propellant then provides the gasses needed to force the Canister 16 from the gun tube in which the ammunition is positioned.

Cap 19 is flat, and is seated within a recess 22 defined by an inner wall 23 of the canister 16, relative to a forwardmost, open end 24 of the canister 16.

Upon exiting the tube, the air pressure on the closing cup coupled with the longitudinal grooves in the Canister and centrifugal force caused by the rifled spinning breaks the Canister apart, so dispensing the payload contained therein.

The described ammunition incorporates a larger payload than was attainable heretofore by being physically larger than its predecessors. This enhances the efficiency and has been found to require no rifling of the gun tube. Additionally, the break up of the structure and the dispersion of the payload will be easier than with any of the prior art versions.

The flat closing cup and cone shaped of the Canister aid in enhancing the dispersion of the contents of the payload area. The described ammunition has been found to be of particular interest in 120 mm guns. The unique design component is the use of the plastic or aluminum Canister which contains and expels the balls and/or cubes without the need for a fuzing or explosive charge system. Additionally, the use of tungsten balls and cubes is unique and it is anticipated that such application will prove to be more effective than previously used flechettes and steel balls.

In summation, the described ammunition is considered a significant advance in the art since there are no known anti-personnel cartridge designs for M1A1/A2 equipment which could be successfully fired from a smoothbore 120 mm gun. The anti-personnel tank cartridges heretofore employed were designed for a rifled gun tube.

It will be appreciated by those skilled in the art that variations in the described device may be made by those skilled in the art without departing from the scope of the invention.

What is claimed is:

1. A munition for use with a gun having a gun tube, comprising:

a cartridge comprising a base member at one end and an adapter case at an opposite end;

a solid propellant contained within a cartridge case of the cartridge;

an electric primer affixed to the base member;

a self-rupturing canister secured to the adapter case, wherein the solid propellant is disposed outside the canister, so that upon initiation of the propellant the canister is propelled through the gun tube;

wherein the canister contains a payload, and is closed by a cap that retains the payload within the canister;

wherein the cap is generally flat and is seated within a recess defined by an inner wall of the canister, relative to a forwardmost, open end of the canister, in order to create a high air pressure area acting against the cap and against the inner wall of the canister within the recess;

wherein the electric primer is disposed within the propellant, away from the canister;

wherein the canister further comprises a plurality of longitudinal grooves; and wherein the longitudinal grooves weaken the structure of the canister, so that during flight, the high air pressure area acting on the cap ruptures the cap, thus allowing air to enter the canister, and to induce an air pressure buildup that causes the canister to break apart at the longitudinal grooves and the payload to be dispersed.

2. The munition in accordance with claim 1, wherein the canister is made of aluminum.

3. The munition in accordance with claim 1, wherein the payload comprises a combination of tungsten balls and tungsten cubes.

4. The munition in accordance with claim 1, wherein the payload comprises steel balls.

5. The munition in accordance with claim 1, wherein the payload comprises tungsten balls.

6. The munition in accordance with claim 1, wherein the cap is generally flat.

7. The munition in accordance with claim 3, wherein the canister comprises a closed, generally domed shaped payload area at one end that is secured to the adapter case.

8. The munition in accordance with claim 7, wherein the canister is releasably secured to the adapter case.

9. The munition in accordance with claim 8, wherein the canister is secured to the adapter case by means of an obturator.

10. The munition in accordance with claim 1, wherein the electric primer is affixed to the base member by means of a spring clip.

11. A cartridge comprising:

a cartridge case;

a self-rupturing canister secured to the cartridge case;

wherein the canister contains a payload, and is closed by a cap that retains the payload within the canister;

wherein the cap is generally flat and is disposed within a recess defined by an inner wall or the canister, relative to a forwardmost, open end of the canister, in order to create a high air pressure area acting against the cap and against the inner wall of the canister within the recess; and wherein during flight, high air pressure acts against the cap and the inner wall of the canister, rupturing the cap to rupture and causing the high air pressure to build up within the canister, rupturing the canister and dispersing the payload.

12. The cartridge in accordance with claim 11, wherein the canister further comprises a plurality of longitudinal grooves.

13. The cartridge in accordance with claim 12, wherein the longitudinal grooves weaken the structure of the canister, so that during flight, the high air pressure area acting on the inner wall of the canister causes the canister to break apart at the longitudinal grooves.

14. The cartridge in accordance with claim 11, wherein the canister is made of aluminum.

15. The munition in accordance with claim 1, wherein the payload comprises a combination of tungsten balls and tungsten cubes.

16. A projectile comprising:

a self-rupturing canister;

wherein the canister contains a payload, and is closed by a cap that retains the payload within the canister;

wherein the cap is generally flat and is disposed within a recess defined by an inner wall of the canister, relative to a forwardmost, open end of the canister, in order to create a high air pressure area acting against the cap and against the inner wall of the canister within the recess; and wherein during flight, high air pressure acts against the cap and the inner wall of the canister, rupturing the cap to rupture and causing the high air pressure to build up within the canister, rupturing the canister and dispersing the payload.

17. The projectile in accordance with claim 16, wherein the canister is made of aluminum.

18. The projectile in accordance with claim 16, wherein the payload comprises a combination of tungsten balls and tungsten cubes.

19. The projectile in accordance with claim 16, wherein the canister comprises a closed, generally domed shaped payload area at one end that is secured to the adapter case.

20. The projectile in accordance with claim 16, wherein the canister is releasably secured to the adapter case.

21. The projectile in accordance with claim 16, wherein the canister further comprises a plurality of angled, longitudinal rifling grooves.

* * * * *